US005658167A

United States Patent [19]

Shindoh

[11] Patent Number: 5,658,167

[45] Date of Patent: Aug. 19, 1997

[54] PANEL-MOUNTED CONNECTOR

[75] Inventor: Satoru Shindoh, Yokohama, Japan

[73] Assignee: The Whitaker Corporation, Wilmington, Del.

[21] Appl. No.: 457,943

[22] Filed: May 31, 1995

[30] Foreign Application Priority Data

Jun. 22, 1994 [JP] Japan ..... 6-139924

[51] Int. Cl.[6] ..... H01R 13/73

[52] U.S. Cl. ..... 439/557

[58] Field of Search ..... 439/552, 553, 439/556, 557, 559; 206/307

[56] References Cited

U.S. PATENT DOCUMENTS

| | | | |
|---|---|---|---|
| 3,353,143 | 11/1967 | Pauza | 439/557 |
| 3,573,716 | 4/1971 | Garver | 439/557 |
| 3,596,233 | 7/1971 | DeVito | 439/557 |
| 4,453,195 | 6/1984 | Sauer et al. | 439/557 X |
| 4,687,276 | 8/1987 | Stockmaster | 439/557 |
| 5,074,801 | 12/1991 | Siemon | 439/557 X |
| 5,199,896 | 4/1993 | Mosquera | 439/557 X |
| 5,435,749 | 7/1995 | Kawase et al. | 439/557 |

FOREIGN PATENT DOCUMENTS

| | | | |
|---|---|---|---|
| 147828 | 7/1985 | European Pat. Off. | 439/557 |
| 60-15268 | 5/1985 | Japan . | |
| 1-124684 | 8/1989 | Japan . | |
| 3-116677 | 12/1991 | Japan . | |

*Primary Examiner*—Allan N. Shoap
*Assistant Examiner*—Christopher T. McDonald
*Attorney, Agent, or Firm*—Timothy J. Aberle

[57] ABSTRACT

A panel connector having a housing 11 which includes a set of first spring-loaded arms 12 extending backward and outside from the left and right side surfaces 11*a* and a set of second spring-loaded arms 13 extending backward and outside from the top and bottom surfaces 11*b*. A set of lugs 14 is provided on the side surfaces 11*a* and 11*b* at the rear of housing 11. The first and second spring-loaded arms 12 and 13 exert an outward pressure on the sides of a panel opening. The first spring-loaded arms 12 have steps 12*c* facing backward, which prevent the housing 11 from being pulled out and the second spring-loaded arms 13 have depressions formed in pressure surface sections 13*b*, which limit movement of housing 11 in and out of the direction of insertion into a panel.

6 Claims, 4 Drawing Sheets

PANEL-MOUNTED CONNECTOR

FIELD OF THE INVENTION

This invention relates to panel-mounted connectors, especially to a connector which is inserted in an opening made in a panel which does not require special mounting fixtures and is distinguished by the simplicity of the mounting operation.

BACKGROUND OF THE INVENTION

At the present time, there are two basic types of panel-mounted connectors. One type is a fixed connector whose housing is secured to a panel by screws or other such fastening devices, for example, the connector described in Japanese Utility Model Publication No. 89-124684. The other type is an easily mounted connector whose housing is inserted in a opening made in a panel and retained there by engagement with the opening, for example, the connector described in Japanese Utility Model Publication No. 85-15268.

The fixed connectors have many parts because they require screws or other fasteners and the process of mounting it to a panel is time consuming. The easily mounted connectors have fewer parts and the process of their mounting is simpler.

Easily mounted connectors do not have their housing secured to the panel, which often results in gaps between the housing and the panel causing a rattling sound. Since these sounds create inconvenience for the user, it is desirable to develop a connector whose housing is firmly retained in the panel and does not produce any sound. Gaps or a loose fit between the housing and the panel can be found in the back-and-forth, right-and-left, and up-and-down directions. So far no models have been offered in which the loose fit can be effectively eliminated in all directions.

This invention takes into consideration the circumstances mentioned above and its purpose is to offer a panel-mounted connector which can be easily mounted while effectively eliminating the loose fit in the back-and-forth, right-and-left, and up-and-down directions.

SUMMARY OF THE INVENTION

The panel-mounted connector according to this invention has a housing which is inserted in an opening made in a panel and mounted to the panel. The housing has lugs extending outside from the side surfaces of the housing that prevent the housing from being pulled through the opening in the direction of insertion. There are spring-loaded arms on the right, left, upper and lower sides of the housing, which slide against the sides of the opening and pushed towards the housing during the insertion of the connector in the opening. One set of the above mentioned spring-loaded arms has steps formed on them facing backwards, which prevent the housing from being pulled out from the opening by the application of pressure against the sides of the opening once inserted. The other set of spring-loaded arms have depressions limiting the movement of the housing in the back and forth directions. This is due to the surfaces of the depressions being slanted relative to the edges that apply pressure on the front and back edges of the opening.

BRIEF DESCRIPTION OF THE DRAWINGS

An embodiment of the invention will now be described by way of example with reference to the accompanying drawings in which:

FIG. 3 is a side view of FIG. 1.

DETAILED DESCRIPTION OF THE INVENTION

Figure 7:
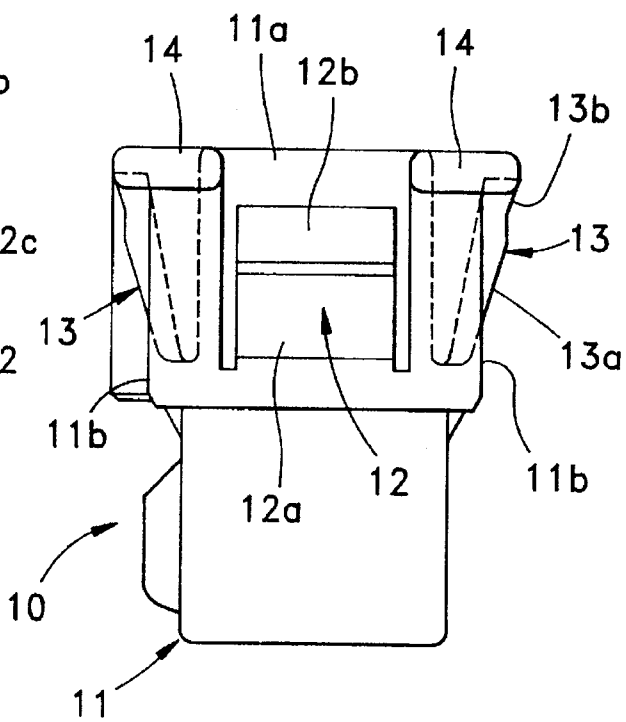
Figure 1:
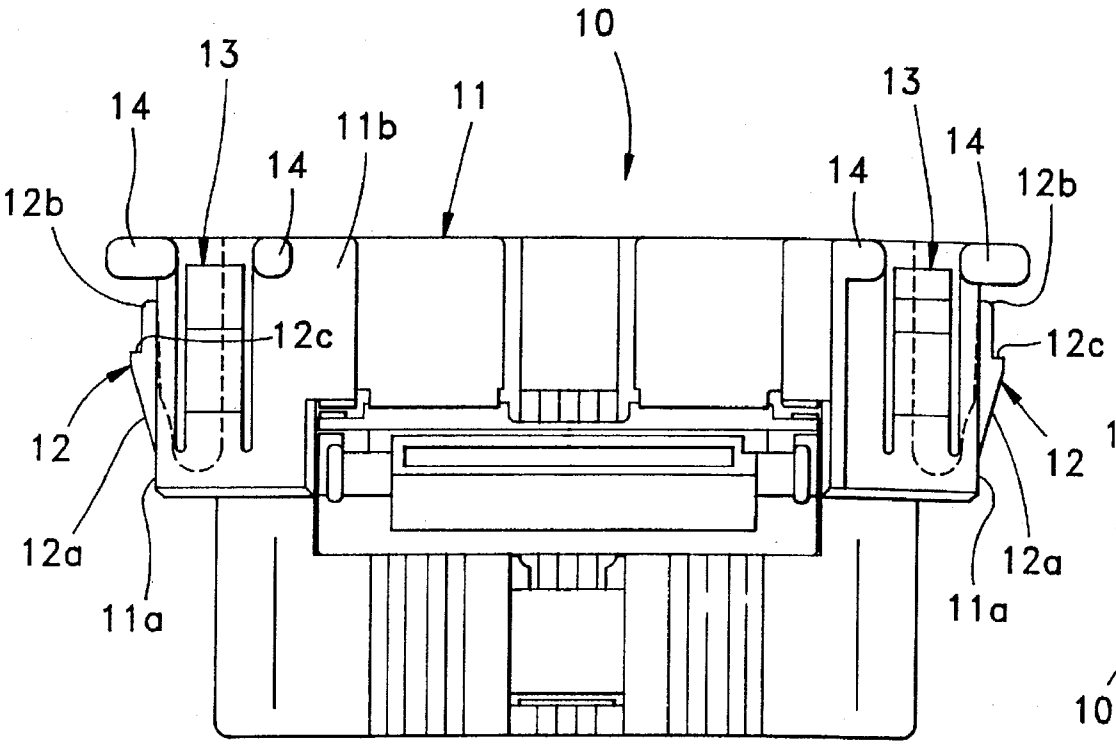
FIG. 1 is a top view of the exterior of the panel-mounted connector according to this invention.
Figure 2:
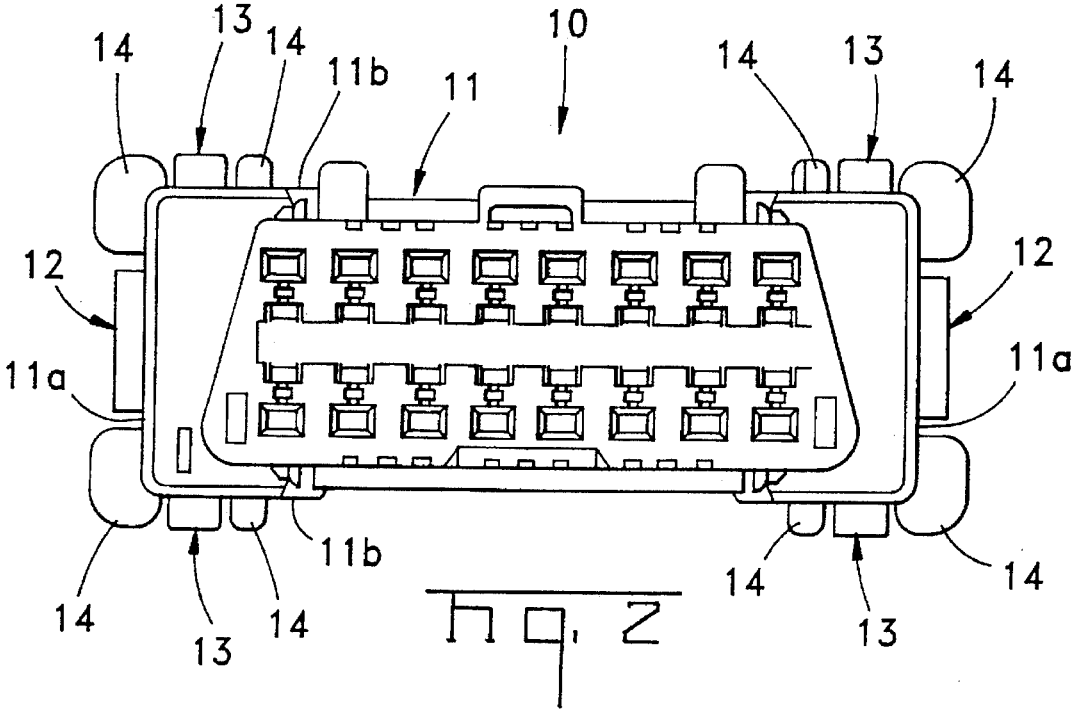
FIG. 2 is a front view of FIG. 1.
Figure 4:
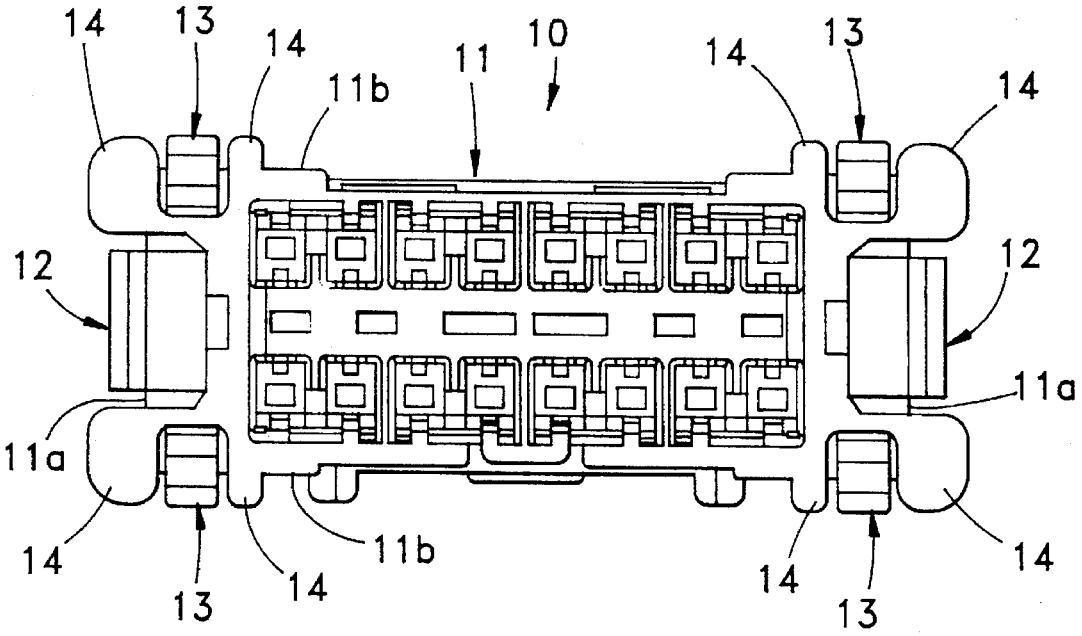
FIG. 4 is a rear view of FIG. 1.

When a panel-mounted connector according to this invention is inserted in a panel opening, a first set of spring-loaded arms formed on the right and left side surfaces of the housing become engaged with the sides of the opening and exert a pressure in the left and right directions, thus eliminating the loose fit in the left and right directions. A second set of spring-loaded arms formed on the top and bottom surfaces of the housing become engaged with the sides of the opening, thus eliminating the loose fit in the up and down directions. In addition, portions of the either first or second set of spring-loaded arms which exert pressure on the opening have depressions so that the pressure is applied to the front and the back edges of the opening at an angle from the sides of the depression, thus restricting the front-to-back movements of the housing.

In addition, a backward facing step is formed on the other set of the spring-loaded arms not having the depressions and there are lugs formed on the housing to prevent the housing from being removed until a strong force is applied to the housing. The lugs can be formed in such a way that they do not come in contact with the panel. In such a case, it becomes possible to reduce the number of locations where the housing is in contact with the panel, thus suppressing the generation of undesirable sounds. It is difficult to achieve a good retention when the panel thickness is not accurate, especially when the panel is thicker than normal, but with the present invention it is easy to compensate for such deviations in the panel thickness.

The following is a detailed explanation of an embodiment of this invention with reference to the attached drawings. The connector 10, shown in FIGS. 1–6, has a housing 11 which is inserted in the opening 21 of panel 20. Left and right side surfaces 11*a* of housing 11 have one pair of first spring-loaded arms 12, formed as an integral part of the housing, which are extending outwardly toward the rear end of the housing. Top and bottom surfaces 11*b* of housing 11 have two pairs of second spring-loaded arms 13, also made as an integral part of the housing, which are extending outwardly toward the rear end of the housing. Large and small lugs 14 are formed as an integral part of the housing 11 on surfaces 11*a* and 11*b* on the rear portion of the housing.

Figure 5:
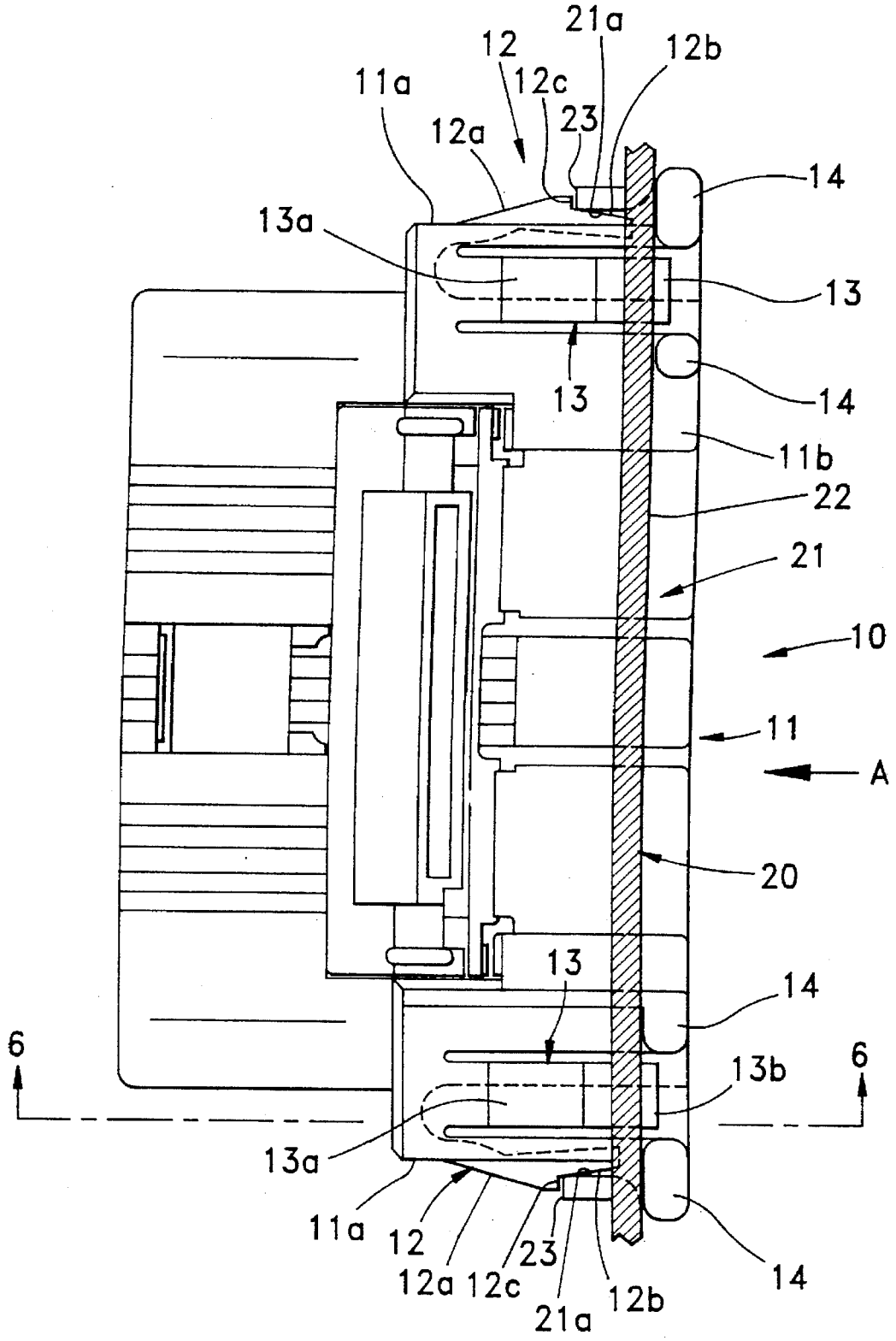
FIG. 5 is a top view of the connector of FIG. 1 mounted to a panel.

The first spring-loaded arms 12 have a slanted surface section 12*a* which comes in contact with side 21*a* of the opening 21 when housing 11 is inserted in the opening 21 as shown in FIG. 5. These arms have a pressure surface section 12*b* which comes in contact with side 21*a* of the opening 21 after the slanted surface section 12*a* passes it and provides pressure directed outwards from housing 11 against side 21*a*. There is also step section 12*c* on the arms 12 facing backwards, which are located between the slanted surface section 12*a* and the pressure surface section 12*b*.

Second spring-loaded arms 13 have a slanted surface section 13*a* which comes in contact with side 21*a* of the opening 21, when housing 11 is inserted in the opening 21. These arms include a pressure surface section 13*b* having a generally V-shaped depression formed in it, which comes in contact with side 21*a* of the opening 21, after the slanted surface section 13*a* passes it and provides a pressure directed outward from the housing 11 against side 21*a* as shown in FIG. 6.

Figure 6:
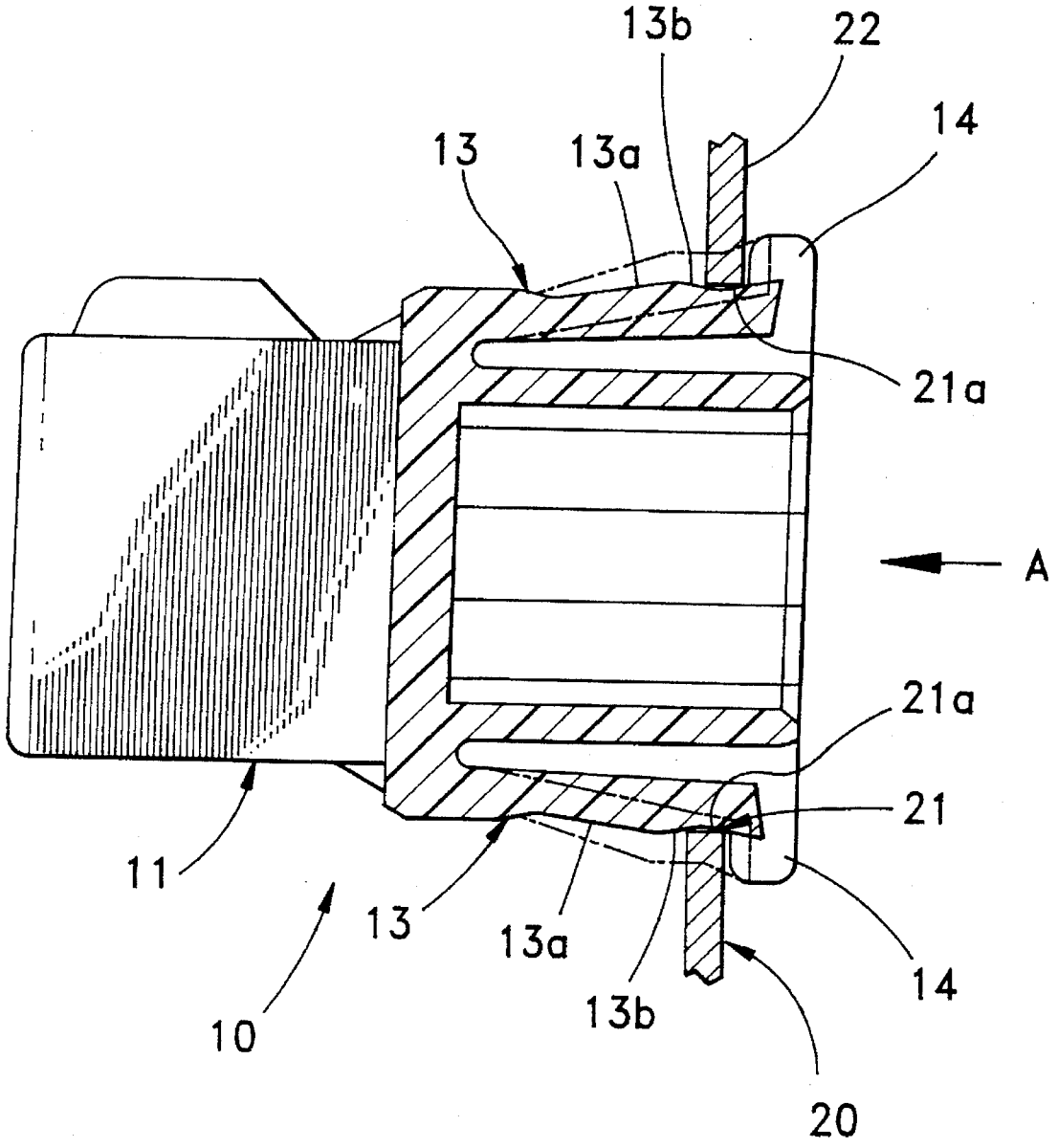
FIG. 6 is a cross-sectional view taken along line 6—6 in FIG. 5.

The mounting of connector 10 can be accomplished by simply inserting housing 11 with the front side first into opening 21 of panel 20 in the direction of the arrow A as shown in FIGS. 5 and 6. During the insertion, slanted surface sections 12*a* of the first spring-loaded arms 12 and slanted surface sections 13*a* of the second spring-loaded arms 13 engage side surfaces 21*a* of opening 21. As a result, the first spring-loaded arms 12 and the second spring-loaded arms 13 are depressed inwards towards housing 11. When housing 11 is inserted even further, the slanted surface sections 12*a*, 13*a* of first and second spring-loaded arms 12, 13 pass beyond side surfaces 21*a* of the opening 21, and the pressure surface sections 12*b* 13*b* of the first and the second spring-loaded arms 12, 13 become engaged with side surfaces 21*a*. At this time, the first and the second spring-loaded arms 12, 13, due to their elasticity, return to their original position so that pressure surface sections 12*b*, 13*b* exert pressure outwardly from housing 11 onto side surfaces 21*a* of the opening 21.

When housing 11 is inserted even further, lugs 14 engage outside surface 22 of the panel 20 (FIGS. 5 and 6), thus preventing further advance of housing 11 in the direction of insertion. As shown in FIGS. 5 and 6, if housing 11 is pulled away from opening 21 after full insertion, steps 12*c* of the first spring-loaded arms 12 engage inside surface 23 of panel 20, thus preventing the housing 11 from being pulled out of the opening.

In the state shown in FIGS. 5 and 6, the pressure surface sections 12*b* of the first spring-loaded arms 12 provide pressure on the left and right side surfaces of the opening 21 directed outwardly, thus eliminating the loose fit of housing 11 in the left-to-right direction. At the same time, the pressure surface sections 13*b* of the second spring-loaded arms 13 provide pressure on the upper and lower sides 21*a* of opening 21 directed outwardly, thus eliminating the loose fit of housing 11 in the up and down direction. In addition, the pressure surface sections 13*b* of the second spring-loaded arms 13 having depressions engage the front and back edges of side surfaces 21*a* of the opening 21 at an oblique angle thereby preventing the housing 11 from moving back and forth relative to the direction of the insertion, in addition to preventing loose fit of the housing 11 in the back and forth direction.

It is desirable to make the gap between steps 12*c* and lugs 14 larger than the thickness of panel 20, including the length of cut and raised surfaces 23 that can be found on a panel, so that lugs 14 are not in contact with panel 20. This makes it possible to reduce the surface area of contact between housing 11 and panel 20 and at the same time to provide a greater tolerance for deviations in thickness of panel 20.

This invention is not limited to only this specific design but also comprises its various modifications. For example, in the above mentioned embodiment, the depressions in the pressure surface sections may be made in the first spring-loaded arms, and the second spring-loaded arms may have steps. It is also possible to provide one set of spring-loaded arms with both steps and depressions made in the pressure surface sections. In addition, the depression in the pressure surface sections of the second spring-loaded arms has a generally V-shaped configuration, but it also may have a generally U-shaped or some other configuration.

I claim:

1. A panel-mounted connector housing to be mounted in an opening in a panel, comprising:

a dielectric housing to be inserted into the opening;

lugs extending from said housing at spaced locations at sides of said housing adjacent a rear portion thereof to prevent the housing from being inserted past the panel;

spring-loaded latching arms on opposing sides of said housing extending rearwardly from a front portion of said housing for springably engaging the panel to latch the housing to the panel; and spring-loaded depression arms on other opposing sides of the housing extending rearwardly from the front portion of said housing and having engaging sections for springably engaging the surface of the opening thereby eliminating a loose fit of the housing in the opening by the action of the spring-loaded latching arms and the spring-loaded depression arms against the panel.

2. A panel-mounted connector housing of claim 1, wherein said engaging sections of the spring-loaded depression arms comprise slanted surface sections which engage sides of the opening in the panel when the panel-mounted connector is first inserted, and pressure surface sections in a generally V-shape that engage and apply pressure against the sides of the opening after said slanted surface sections pass the sides of the opening.

3. A panel-mounted connector housing of claim 1, wherein said lugs have different sizes.

4. A panel-mounted connector housing of claim 1, wherein said spring-loaded latching arms comprise slanted surface sections which engage sides of the opening in the panel when the panel-mounted connector is first inserted, step sections that engage the sides of the opening when said slanted surface sections pass the sides of the opening and pressure sections that apply pressure against the side of the opening after engagement by said step sections.

5. A panel-mounted connector housing of claim 4, wherein a gap between said step sections and said lugs is larger than the thickness of the panel so that said lugs do not contact said panel.

6. A panel-mounted connector housing of claim 1, wherein said engaging sections of the spring-loaded depression arms comprise slanted surface sections which engage sides of the opening in the panel when the panel-mounted connector is first inserted, and pressure surface sections in a generally V-shape that engage and apply pressure against the sides of the opening after said slanted surface sections pass the sides of the opening.

* * * * *